US008491277B2

(12) United States Patent
Kawabata et al.

(10) Patent No.: US 8,491,277 B2
(45) Date of Patent: Jul. 23, 2013

(54) SUBMERSIBLE MOTOR PUMP, MOTOR PUMP, AND TANDEM MECHANICAL SEAL

(75) Inventors: Junya Kawabata, Tokyo (JP); Chikara Makino, Tokyo (JP); Shunichi Aiyoshizawa, Tokyo (JP)

(73) Assignee: Ebara Corporation, Tokyo (JP)

( * ) Notice: Subject to any disclaimer, the term of this patent is extended or adjusted under 35 U.S.C. 154(b) by 165 days.

(21) Appl. No.: 12/859,915

(22) Filed: Aug. 20, 2010

(65) Prior Publication Data

US 2011/0200469 A1 Aug. 18, 2011

(30) Foreign Application Priority Data

Feb. 12, 2010 (JP) ..... 2010-28863
Feb. 12, 2010 (JP) ..... 2010-28864
Feb. 12, 2010 (JP) ..... 2010-28865

(51) Int. Cl.
*F04B 39/06* (2006.01)
*H02K 9/00* (2006.01)
*H02K 5/12* (2006.01)

(52) U.S. Cl.
USPC ..... 417/368; 417/423.3; 310/54; 310/87

(58) Field of Classification Search
USPC ..... 310/54, 58, 64, 87, 52, 4, 875; 417/366, 417/367, 368, 372, 423.3, 423.14
IPC ..... H02K 9/19,5/20, 5/132
See application file for complete search history.

(56) References Cited

U.S. PATENT DOCUMENTS 3,371,613 A * 3/1968 Dahlgren et al. ..... 417/368
3,653,785 A 4/1972 Dahlgren et al.
4,114,899 A 9/1978 Külzer et al.
4,361,334 A 11/1982 Amorese et al.
4,725,198 A 2/1988 Fraser
5,181,729 A 1/1993 Forssberg et al.
5,250,863 A 10/1993 Brandt
5,616,973 A 4/1997 Khazanov et al.
5,961,309 A * 10/1999 Harpole et al. ..... 418/181
6,121,698 A 9/2000 Sexton
6,305,692 B1 10/2001 Arbeus
6,446,975 B1 9/2002 Bratthall
6,632,075 B2 10/2003 Hallgren (Continued)

FOREIGN PATENT DOCUMENTS

DE 102 08 688 9/2003
DE 10208688 A1 * 9/2003

(Continued)

OTHER PUBLICATIONS

International Search Report issued Aug. 9, 2011 in corresponding International (PCT) Application No. PCT/JP2010/068099.

*Primary Examiner* — Devon Kramer
*Assistant Examiner* — Bryan Lettman
(74) *Attorney, Agent, or Firm* — Wenderoth, Lind & Ponack, L.L.P.

(57) ABSTRACT

A submersible motor pump includes a water jacket having a circulation passage of a coolant, a centrifugal impeller for circulating the coolant, a suction passage configured to provide fluid communication between the circulation passage and a fluid inlet of the centrifugal impeller, and a discharge passage configured to provide fluid communication between a fluid outlet of the centrifugal impeller and the circulation passage. The discharge passage includes a heat-exchange passage formed by two wall surfaces, one of which is constituted by a member which contacts a liquid conveyed by a main impeller. The heat-exchange passage has a circular shape extending radially outwardly from the fluid outlet of the centrifugal impeller. The heat-exchange passage includes at least one axial passage section having a length component in an axial direction of the rotational shaft.

13 Claims, 8 Drawing Sheets

U.S. PATENT DOCUMENTS

| | | | |
|---|---|---|---|
| 7,102,267 | B2 | 9/2006 | Gromoll et al. |
| 7,122,923 | B2 | 10/2006 | Lafontaine et al. |
| 7,154,201 | B2 | 12/2006 | Kuhn |
| 7,429,809 | B2 | 9/2008 | Huster et al. |

FOREIGN PATENT DOCUMENTS

| | | |
|---|---|---|
| EP | 0 013 869 | 8/1980 |
| EP | 0 959 277 | 11/1999 |
| EP | 0 990 800 | 4/2000 |
| JP | 56-113093 | 9/1981 |
| JP | 11-325258 | 11/1999 |
| JP | 2000-110768 | 4/2000 |
| JP | 2002-310088 | 10/2002 |
| JP | 2005-282469 | 10/2005 |
| JP | 2006-125208 | 5/2006 |
| WO | 01/25634 | 4/2001 |

* cited by examiner

SUBMERSIBLE MOTOR PUMP, MOTOR PUMP, AND TANDEM MECHANICAL SEAL

BACKGROUND OF THE INVENTION

1. Field of the Invention

The present invention relates to a submersible motor pump having a cooling mechanism for a motor.

The present invention also relates to a motor pump for delivering a liquid.

The present invention further relates to a tandem mechanical seal for use in a submersible motor pump.

2. Description of the Related Art

A submersible motor pump is widely used for delivering a liquid, such as sewage, wastewater, or river water, which contains debris and dirt therein. Typically, a motor is disposed above an impeller. Accordingly, under low water level conditions, the pump is operated with the motor exposed in the atmosphere. In order to cool the motor sufficiently even in such a situation, a water jacket is provided around the motor and a liquid circulates through the water jacket to thereby cool the motor.

Liquids for use in cooling of the motor include a handled liquid of the pump (i.e., a liquid to be conveyed by the pump) and a coolant dedicated for the cooling purpose. In the case of using the handled liquid of the pump, the dirt and debris can accumulate in the water jacket or cause clogging of the water jacket. As a result, the need for frequent maintenance may arise. Therefore, there has been an increasing demand for the water jacket using the dedicated coolant.

In the case of using the coolant (or cooling liquid), it is necessary to install a mechanism for circulating the coolant, in addition to a main impeller for delivering the handled liquid. As such a circulating mechanism, there has been proposed an impeller, which is provided on a rotational shaft separately from the main impeller, for circulating the coolant. The coolant should be isolated sufficiently from the motor and the handled liquid. Further, the motor should also be separated from the handled liquid. A tandem mechanical seal, which has two mechanical seals arranged in series, is conventionally used as a seal mechanism for separating the motor from the handled liquid. It has also been proposed to provide an impeller of the circulating mechanism between the two mechanical seals. However, the tandem mechanical seal, containing the impeller therein, has a complex structure. In particular, when using a centrifugal impeller as the impeller for circulating the coolant, it is necessary to devise structures for assembly.

Further, in the motor cooling mechanism using the coolant, it is necessary to provide a mechanism for dissipating heat, which has been transferred from the motor, into the exterior of a circulation passage of the coolant. One of the proposed solutions is to dissipate the heat of the coolant by heat exchange between the coolant and the handled liquid through a pump casing. However, a space between the motor and the pump casing is limited and therefore it is difficult to secure a sufficient heat-transfer area for the heat exchange. Further, air pocket (i.e., trapped air) is likely to be created in a housing space of the main impeller (e.g., in a region above the main impeller, in particular in a region behind the main impeller). Such air pocket can hinder the heat exchange between the coolant and the handled liquid. Further, the air pocket also hinders lubrication and cooling of the mechanical seal. As a result, a lifetime of the mechanical seal could be shortened.

SUMMARY OF THE INVENTION

It is therefore a first object of the present invention to provide a submergible motor pump capable of performing heat exchange effectively between a coolant circulating through a water jacket enclosing a motor and a liquid handled by the pump.

It is a second object of the present invention to provide a motor pump capable of quickly and securely expelling air staying at a rear side of a main impeller for delivering a liquid.

It is a third object of the present invention to provide a tandem mechanical seal having a centrifugal impeller, arranged between two mechanical seals, for circulating a coolant.

The heat exchange between the coolant and the handled liquid is performed through a heat-exchange member, and the coolant is forced to circulate by the centrifugal impeller. Therefore, the cooling action by the coolant is based on forced convection heat transfer. A quantity of heat in the heat transfer is proportional to a heat transfer area and a heat transfer coefficient. The heat transfer coefficient in forced convection heat transfer is expressed by Reynolds number and Prandtl number. The higher the velocity of the coolant is, the larger the heat transfer coefficient is, provided that factors determined by physical property of the coolant and the like are eliminated. Therefore, the quantity of heat in the heat transfer can be increased and the efficiency of the heat exchange between the coolant and the handled liquid can be increased by providing a large heat-transfer area and by increasing flow velocity of the coolant flowing over a heat-transfer surface. In order to increase the flow velocity of the coolant, it is also useful to provide a narrower passage through which the coolant flows.

In order to achieve the first object of the present invention, one aspect of the present invention provides a submersible motor pump, including: a water jacket having a circulation passage of a coolant; a motor surrounded by the water jacket; a rotational shaft rotated by the motor; a main impeller secured to the rotational shaft; a centrifugal impeller for circulating the coolant, the centrifugal impeller being rotatable together with the rotational shaft; a suction passage configured to provide fluid communication between the circulation passage and a fluid inlet of the centrifugal impeller; and a discharge passage configured to provide fluid communication between a fluid outlet of the centrifugal impeller and the circulation passage. The discharge passage includes a heat-exchange passage formed by two wall surfaces facing each other. One of the two wall surfaces is constituted by a member which contacts a liquid conveyed by the main impeller. The heat-exchange passage has a circular shape extending radially outwardly from the fluid outlet of the centrifugal impeller. The heat-exchange passage includes at least one axial passage section having a length component in an axial direction of the rotational shaft.

In a preferred aspect of the present invention, the axial passage section further has a length component in a radial direction of the centrifugal impeller, and the length component in the axial direction is longer than the length component in the radial direction.

In a preferred aspect of the present invention, the heat-exchange passage further includes at least one radial passage section having only a length component in a radial direction of the centrifugal impeller.

In a preferred aspect of the present invention, the submergible motor pump further includes guide vanes provided in the radial passage section.

In a preferred aspect of the present invention, the at least one axial passage section comprises a first axial passage section and a second axial passage section, the at least one radial passage section comprises a first radial passage section and a second radial passage section, and the first radial passage section, the first axial passage section, the second radial passage section, and the second axial passage section are arranged in this order to provide the heat-exchange passage.

In a preferred aspect of the present invention, the heat-exchange passage has substantially a constant height over an entire length thereof.

In a preferred aspect of the present invention, the circulation passage comprises an outward passage and a return passage which are separated by partition plates, the discharge passage is connected to an inlet of the outward passage, an outlet of the outward passage is connected to an inlet of the return passage, and an outlet of the return passage is connected to the suction passage.

In a preferred aspect of the present invention, a flexible block is disposed in the water jacket, and a region of a gas contacting the coolant does not substantially exist in the circulation passage.

In a preferred aspect of the present invention, the flexible block comprises a closed-cell foam rubber sponge.

According to the present invention, the centrifugal impeller is employed as an impeller for circulating the coolant. Therefore, pressure of the coolant can be increased, and as a result the coolant can circulate through the narrow passage. Consequently, the flow velocity of the coolant can be high and the efficiency of the heat exchange can be improved. Further, because the axial passage section exists, the heat-transfer area can be increased without enlarging the radial size of the heat-exchange passage. Furthermore, because swirling flow of the coolant, formed by the centrifugal impeller, is not destroyed in the heat-exchange passage, the flow velocity of the coolant is kept high and therefore the efficiency of the heat exchange can be improved.

In order to achieve the second object of the present invention, one aspect of the present invention provides a motor pump, including: a motor; a rotational shaft rotated by the motor; an impeller secured to the rotational shaft; and an annular wall arranged above the impeller. The impeller has main blades for pressurizing a liquid and rear vanes facing the annular wall. The annular wall is shaped so as to separate a space above the impeller into an inner circumferential space and an outer circumferential space. The annular wall has a return channel through which part of the liquid conveyed radially outwardly by the rear vanes is returned to the inner circumferential space.

In a preferred aspect of the present invention, a baffle for disturbing swirling flow of the liquid is provided in the inner circumferential space.

In a preferred aspect of the present invention, the annular wall has an upward channel through which part of the liquid conveyed radially outwardly by the rear vanes is directed upwardly from the rear vanes, and the upward channel is in fluid communication with the outer circumferential space.

In a preferred aspect of the present invention, the annular wall forms a heat-exchange passage for performing heat exchange between the liquid and a coolant. The motor pump further includes a water jacket surrounding the motor, and a circulating mechanism for circulating the coolant between the water jacket and the heat-exchange passage.

Another aspect of the present invention provides a motor pump, including: a motor; a rotational shaft rotated by the motor; an impeller secured to the rotational shaft; and an annular wall arranged above the impeller. The impeller has main blades for pressurizing a liquid and rear vanes facing the annular wall. The annular wall is shaped so as to separate a space above the impeller into an inner circumferential space and an outer circumferential space. The annular wall has an upward channel through which part of the liquid conveyed radially outwardly by the rear vanes is directed upwardly from the rear vanes, and the upward channel is in fluid communication with the outer circumferential space.

In a preferred aspect of the present invention, the annular wall forms a heat-exchange passage for performing heat exchange between the liquid and a coolant. The motor pump further includes a water jacket surrounding the motor, and a circulating mechanism for circulating the coolant between the water jacket and the heat-exchange passage.

According to the present invention, pump action by the rear vanes on the rear side of the impeller stirs the air staying in the space above the impeller together with the liquid, thereby expelling the stagnant air. Further, because the liquid (i.e., the object liquid handled by the pump) is stirred and circulated even after the air is expelled, the heat exchange between the coolant and the liquid is accelerated through the annular wall.

The centrifugal impeller has a fluid outlet having a larger diameter than that of a fluid inlet thereof, and a liner ring is provided around the fluid inlet. Accordingly, in a case where the centrifugal impeller is arranged in a tandem mechanical seal, it is necessary to insert the liner ring into a space between the centrifugal impeller and a mechanical seal at the inlet side of the centrifugal impeller. Since the liner ring has a smaller diameter than that of the mechanical seal, it becomes difficult to insert the liner ring if the tandem mechanical seal is structured as an integrally assembled unit In order to achieve the third object of the present invention, one aspect of the present invention provides a tandem mechanical seal for use in a rotary machine having a rotational shaft. The tandem mechanical seal includes: a first seal unit having a first sleeve to be mounted on the rotational shaft, a first rotary seal ring rotatable together with the first sleeve, a first stationary seal section contacting the first rotary seal ring, and a first spring mechanism configured to press the first rotary seal ring and the first stationary seal section against each other; and a second seal unit having a second sleeve to be mounted on the rotational shaft, a second rotary seal ring rotatable together with the second sleeve, a second stationary seal section contacting the second rotary seal ring, a second spring mechanism configured to press the second rotary seal ring and the second stationary seal section against each other, and a centrifugal impeller rotatable together with the second sleeve. An end surface of the first sleeve and an end surface of the second sleeve are brought into contact with each other when the first seal unit and the second seal unit are mounted on the rotary machine. The centrifugal impeller is located between a sealing surface of the first seal unit and a sealing surface of the second seal unit.

In a preferred aspect of the present invention, the first seal unit further includes a first displacement restriction mechanism configured to restrict a displacement of the first stationary seal section with respect to the first sleeve, and the first displacement restriction mechanism is arranged in a position such that contact between the first rotary seal ring and the first stationary seal section is maintained by stretch of the first spring mechanism.

In a preferred aspect of the present invention, the first stationary seal section has a first stationary seal ring contacting the first rotary seal ring and a first static member to be secured to the rotary machine.

In a preferred aspect of the present invention, the second spring mechanism is located between the second sleeve and the second rotary seal ring, and the second seal unit further includes a second displacement restriction mechanism configured to couple the second sleeve and the second rotary seal ring to each other and to restrict a displacement of the second rotary seal ring with respect to the second sleeve.

In a preferred aspect of the present invention, the second stationary seal section has a second stationary seal ring contacting the second rotary seal ring and a second static member to be secured to the rotary machine.

In a preferred aspect of the present invention, the first sleeve has a first positioning surface brought into contact with a first step surface formed on the rotational shaft, and the second sleeve has a second positioning surface brought into contact with a second step surface formed on the rotational shaft.

In a preferred aspect of the present invention, the second spring mechanism is provided on a boss of the centrifugal impeller.

According to the present invention, the first sleeve and the second sleeve are divided and the tandem mechanical seal is constructed by the first seal unit and the second seal unit as separate assemblies. These first seal unit and the second seal unit can be installed individually on the rotary machine. Therefore, even when the centrifugal impeller, which has a large diameter and high discharge pressure, is employed, the tandem mechanical seal can be installed in the rotary machine.

DETAILED DESCRIPTION OF THE PREFERRED EMBODIMENTS

Figure 1:
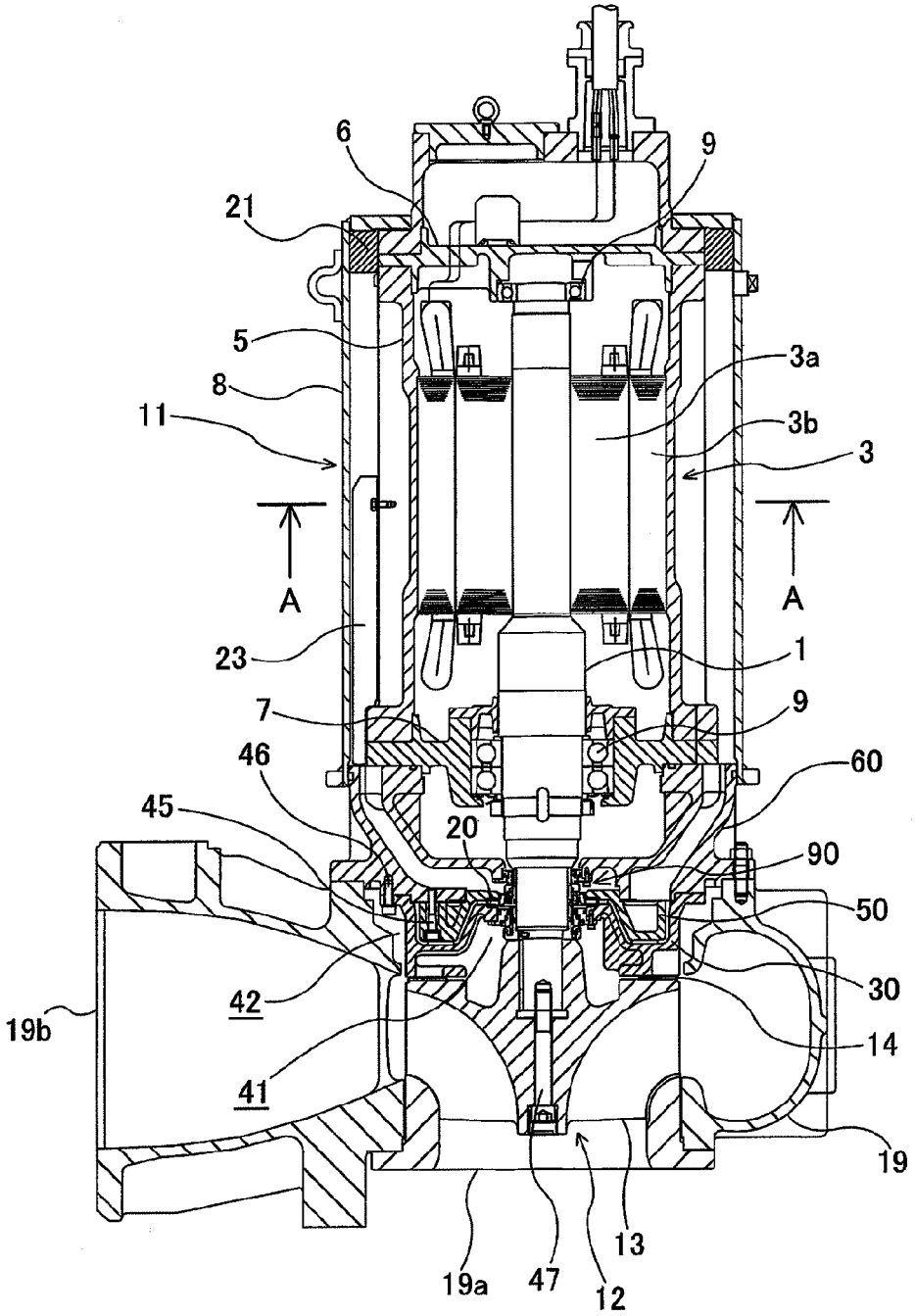
FIG. 1 is a cross-sectional view showing a submersible motor pump according to an embodiment of the present invention.
Figure 2:
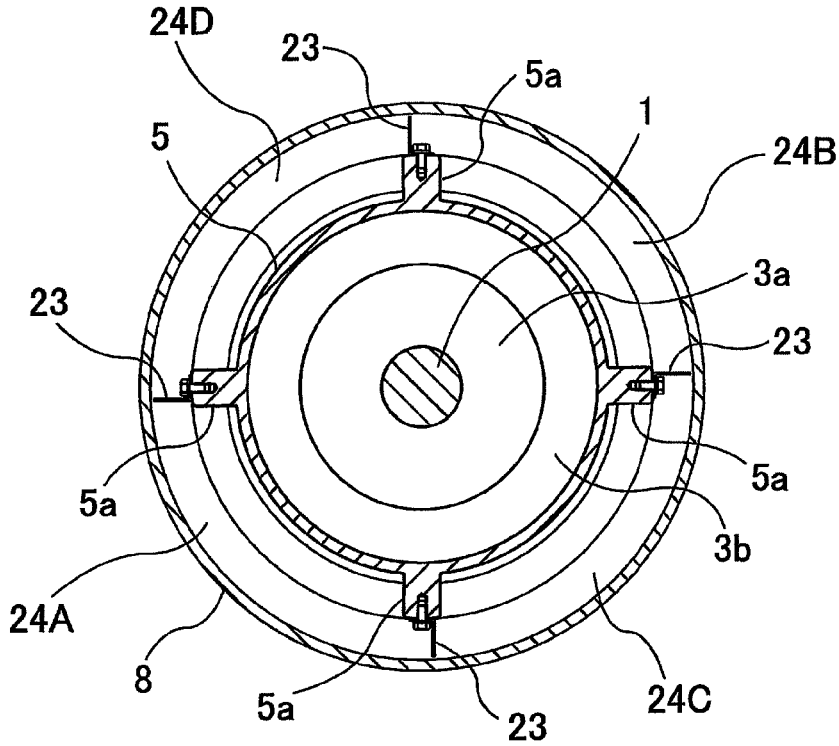
FIG. 2 is a cross-sectional view taken along line A-A in FIG. 1.

FIG. 1 is a cross-sectional view showing a submersible motor pump according to an embodiment of the present invention. FIG. 2 is a cross-sectional view taken along line A-A in FIG. 1. A motor shaft and a pump shaft are formed integrally to provide a rotational shaft 1. A motor rotor 3*a* is secured to the rotational shaft 1, and a motor stator 3*b* is arranged so as to surround the motor rotor 3*a*. The motor stator 3*b* is secured to an inner circumferential surface of a cylindrical motor casing 5. A top cover 6 and a bottom cover 7 are attached to an upper end and a lower end of the motor casing 5, respectively. The motor casing 5, the top cover 6, and the bottom cover 7 define a hermetically closed space in which the motor rotor 3*a* and the motor stator 3*b* are housed to constitute a motor 3.

Bearings 9 are provided on the top cover 6 and the bottom cover 7. The rotational shaft 1 is rotatably supported by these bearings 9. A main impeller 12 is secured to an end of the rotational shaft 1. This main impeller 12 is housed in a volute casing 19 having a pump suction opening 19*a* and a pump discharge opening 19*b*. A tandem mechanical seal 90 is provided between the motor 3 and the main impeller 12. This tandem mechanical seal 90 serves to prevent a handled liquid of the pump from entering the motor 3.

A cylindrical outer cover 8 is provided around the motor casing 5, so that a space is formed between the motor casing 5 and the outer cover 8. The motor casing 5 and the outer cover 8 constitute a water jacket 11 through which a coolant (or cooling liquid) for the motor 3 flows. The water jacket 11 is filled with the coolant (which is typically anti-freezing solution, such as ethylene glycol solution). The tandem mechanical seal 90 includes a centrifugal impeller 20 which is rotatable together with the rotational shaft 1. The coolant is pressurized by the rotation of the centrifugal impeller 20. The coolant performs heat exchange with the handled liquid of the pump and is then supplied into the water jacket 11. After cooling the motor 3 at the water jacket 11, the coolant is retuned to the centrifugal impeller 20 again. In this manner, the coolant circulates between the centrifugal impeller 20 and the water jacket 11.

An annular closed-cell foam rubber sponge 21 is fitted into the uppermost portion of the water jacket 11. This rubber sponge 21 is provided for the following reason. If air exists in the water jacket 11, the air is swallowed up in the flow of the coolant, making the coolant cloudy. As a result the cooling efficiency is lowered to some degree. On the other hand, when the water jacket 11 is filled with the coolant, a volume change of the coolant due to a change in temperature thereof cannot be absorbed. Thus, the rubber sponge 21, which is a flexible block made of soft material that does not allow the coolant to permeate, is disposed in the water jacket 11. If the water jacket 11 has a sufficient cooling capacity, an air layer may be provided instead of the flexible block, because the cloudy coolant does not cause a great decrease in the cooling efficiency.

As shown in FIG. 2, four vertically extending ribs 5*a* are provided on an outer circumferential surface of the motor casing 5. Further, four partition plates 23, which partition the interior space of the water jacket 11 in a circumferential direction, are mounted on the four ribs 5*a*, respectively. An inner circumferential surface of the outer cover 8 and the partition plates 23 may not be in contact. The partition plates 23 extend vertically from the lower end of the water jacket 11 to a predetermined position to form four circulation passages 24A, 24B, 24C, and 24D in the water jacket 11. Two of the four circulation passages provide outward passages (indicated by reference numerals 24A and 24B) of the coolant, and the other two provide return passages (indicated by reference numerals 24C and 24D) of the coolant. The arrangement of the outward passages 24A and 24B is axisymmetric, and the arrangement of the outward passages 24C and 24D is also axisymmetric.

Cooling of the motor 3 is performed by the heat exchange between the coolant flowing through the water jacket 11 and the motor 3 through the motor casing 5. The temperature of the coolant is increased after cooling the motor 3. Therefore, if the coolant itself cannot be cooled, the motor 3 could be overheated. It is possible to release heat through the outer cover 8 into the environment around the water jacket 11. However, when the outer cover 8 is exposed in the atmosphere, sufficient release of heat cannot be expected. Therefore, it is preferable to perform sufficient release of heat via heat exchange between the coolant and the handled liquid of the pump, as discussed below.

Mixing of the coolant and the handled liquid should be avoided. Therefore, the heat exchange between the coolant and the handled liquid is performed through a certain member (i.e., a heat-exchange member). That is, in the heat exchange between the coolant and the handled liquid, the heat transfer coefficient between the heat-exchange member and the coolant and handled liquid is important. Generally, a quantity of heat transferred between a fluid and an object becomes larger as heat transfer area becomes larger, and the heat transfer coefficient becomes larger as the flow velocity of the fluid becomes higher. When the fluid flows through a narrow passage, the flow velocity increases, but on the other hand a resistance of the passage becomes greater and as a result pressure loss becomes larger. Therefore, it is preferable to use, as the circulation impeller for the coolant, a centrifugal impeller that can realize a high head with respect to flow rate. In order to further increase the efficiency, it is preferable to use a closed-type centrifugal impeller.

The centrifugal impeller 20 for circulating the coolant is incorporated in the tandem mechanical seal 90. This tandem mechanical seal 90 is housed in a pump casing that is constituted by a side plate 30, an inner casing 50, and an intermediate casing 60. The intermediate casing 60 is secured to lower portions of the bottom cover 7 and the outer cover 8. The inner casing 50 and the side plate 30 are secured to a lower portion of the intermediate casing 60 by bolts 45 and 46. The inner casing 50 is disposed above the side plate 30. The volute casing 19 is secured to the lower portion of the intermediate casing 60. A housing space of the main impeller 12 is formed by the side plate 30 and the volute casing 19.

Figure 3:
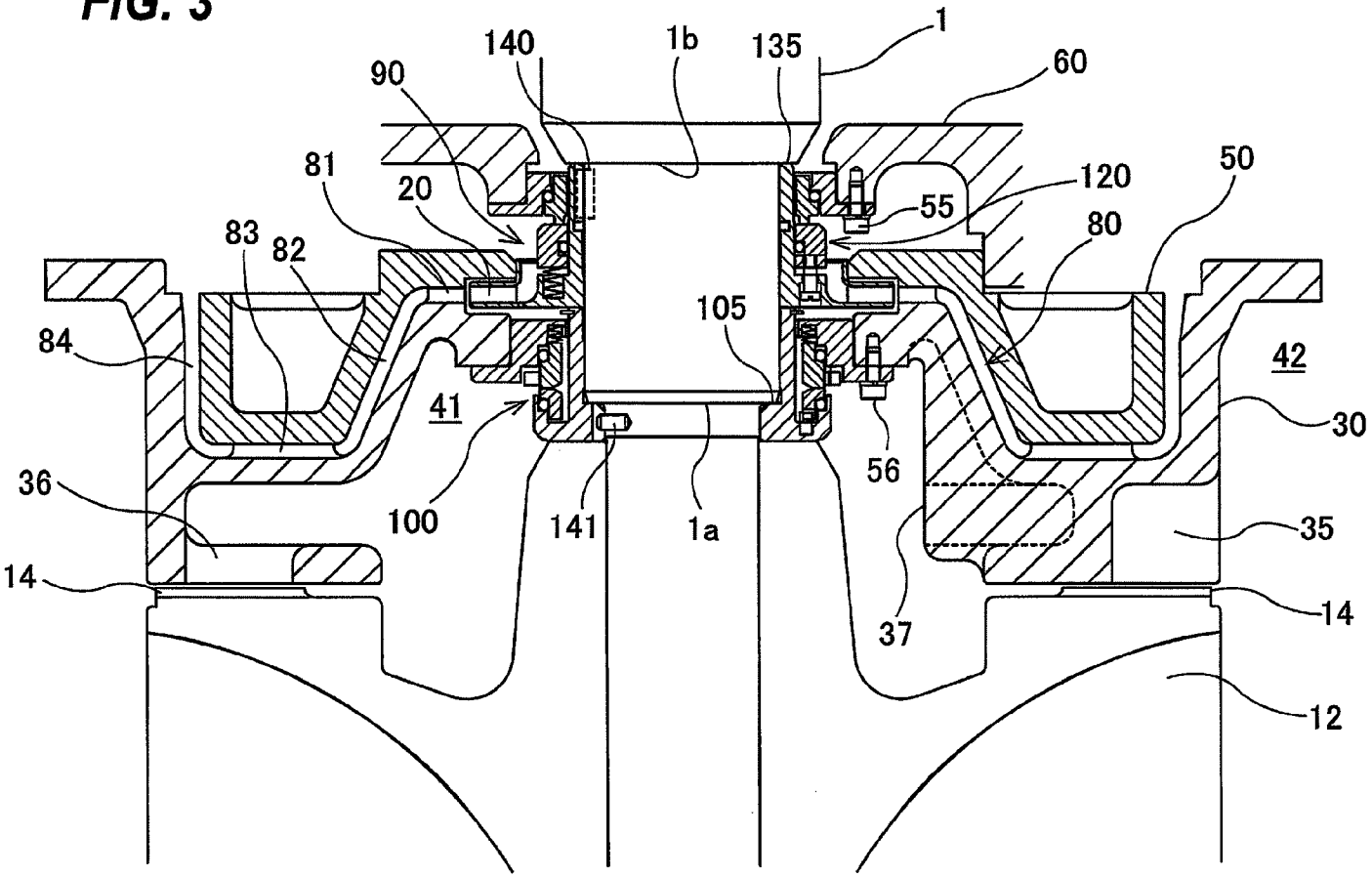
FIG. 3 is an enlarged cross-sectional view showing a tandem mechanical seal and a pump casing shown in FIG. 1.

FIG. 3 is an enlarged cross-sectional view showing the tandem mechanical seal and the pump casing shown in FIG. 1. As shown in FIG. 3, in this embodiment, a closed-type centrifugal impeller 20 is used as the circulation impeller for the coolant. This centrifugal impeller 20 is interposed between the inner casing 50 and the side plate 30. A heat-exchange passage 80, extending in a disk shape, is provided between the inner casing 50 and the side plate 30. More specifically, the heat-exchange passage 80 is formed by a lower surface of the inner casing 50 and an upper surface of the side plate 30. This heat-exchange passage 80 extends radially outwardly from a fluid outlet of the centrifugal impeller 20, and has a circular shape as viewed from an axial direction. The fluid outlet of the centrifugal impeller 20 faces an inlet of the heat-exchange passage 80, so that the coolant, discharged from the centrifugal impeller 20, flows into the heat-exchange passage 80. Distance between the lower surface of the inner casing 50 and the upper surface of the side plate 30, which constitute wall surfaces of the heat-exchange passage 80, is small and is substantially constant throughout the heat-exchange passage 80 in its entirety. Therefore, a cross section of the heat-exchange passage 80 only expands with a radial position, and a height of the heat-exchange passage 80 is substantially constant over the entire length thereof.

The heat-exchange passage 80 includes an inner horizontal passage (a first radial passage section) 81 surrounding the centrifugal impeller 20, an inner axial passage (a first axial passage section) 82 connected to the inner horizontal passage 81, an outer horizontal passage (a second radial passage section) 83 connected to the inner axial passage 82, and an outer axial passage (a second axial passage section) 84 connected to the outer horizontal passage 83. The inner horizontal passage 81 has a flat annular shape extending radially outwardly from the centrifugal impeller 20. The inner axial passage 82 extends axially from the inner horizontal passage 81 toward the main impeller 12 while extending radially outwardly to have an approximately truncated cone shape as a whole. The outer horizontal passage 83 has a flat annular shape extending radially outwardly from the inner axial passage 82. The outer axial passage 84 extends axially from the outer horizontal passage 83 toward the motor 3 to have an approximately cylindrical shape as a whole.

The inner axial passage 82 has both a length in the axial direction and a length in the radial direction, and the axial length is longer than the radial length. The inner axial passage 82 has the length in the radial direction for the following reasons. The first reason is to reduce pressure loss caused by a great change in the flow direction (i.e., from the radial direction to the axial direction) of the coolant with large kinetic energy immediately after the coolant is discharged from the centrifugal impeller 20. The second reason is that, if the inner axial passage 82 has only the length in the axial direction, an interior space (indicated by reference numeral 41) of the side plate 30 adjacent to the inner axial passage 82 becomes small and the handled liquid is likely to stay in this space.

The coolant, pressurized by the centrifugal impeller 20, has a velocity component in a swirling direction. By not disturbing this swirling flow, relative velocity between the side plate 30 (i.e., the heat-exchange member) and the coolant can be kept high. Further, the heat-exchange passage 80 includes the axial passage section which extends substantially in the axial direction. In such axial passage section, the cross-sectional area of the passage hardly increases. Therefore, the axial passage section of the heat-exchange passage 80 can prevent the decrease in the velocity of the coolant while maintaining a large heat-transfer area. Although a maximum radius of the heat-exchange passage 80 that can be used for the heat exchange is limited by the diameter of the main impeller 12 or the diameter of the motor 3, the heat-exchange passage 80 can be made long by providing the axially extending passage.

Figure 4A:
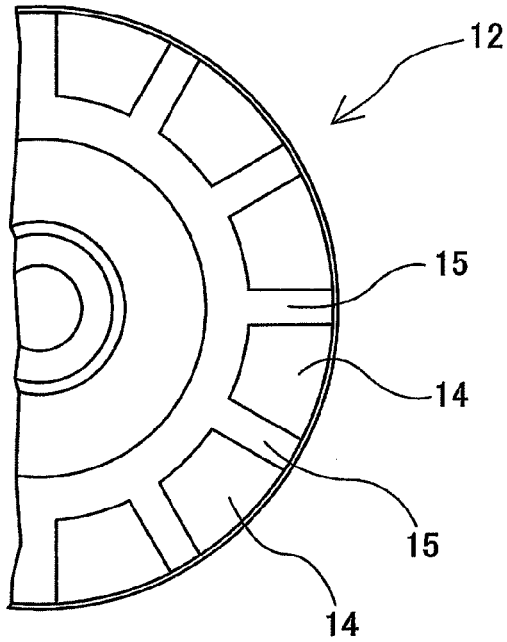
FIG. 4A is a plan view showing part of a main impeller.
Figure 4B:
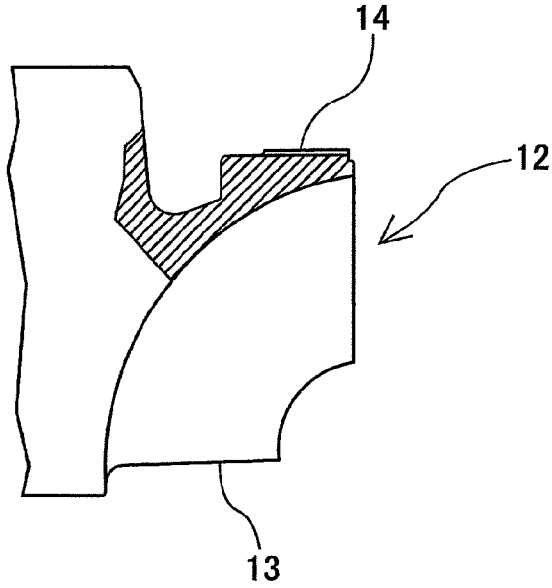
FIG. 4B is a partial cross-sectional view showing the main impeller.

FIG. 4A is a plan view showing part of the main impeller, and FIG. 4B is a partial cross-sectional view showing the main impeller. The main impeller 12 includes a plurality of main blades 13 for pressurizing the liquid. The main impeller 12 is disposed such that the main blades 13 face the pump suction opening 19*a* (see FIG. 1). A plurality of rear vanes 14 are provided on a rear surface (an upper surface) of the main impeller 12. More specifically, radially extending grooves 15 are formed on the rear surface of the main impeller 12, and the rear vanes 14 are formed between these grooves 15. The rear vanes 14 are arranged around the center of the main impeller 12 at equal intervals, and are disposed so as to face the side plate (annular wall) 30, as shown in FIG. 3. The rear vanes 14 rotate together with the main impeller 12 to stir and circulate the liquid existing around the side plate 30, thus preventing reduction of the efficiency of the heat exchange. In this embodiment, the main impeller 12 is described as an impeller constituting a volute type mixed flow pump. However, the main impeller 12 is not limited to this example.

Figure 5A:
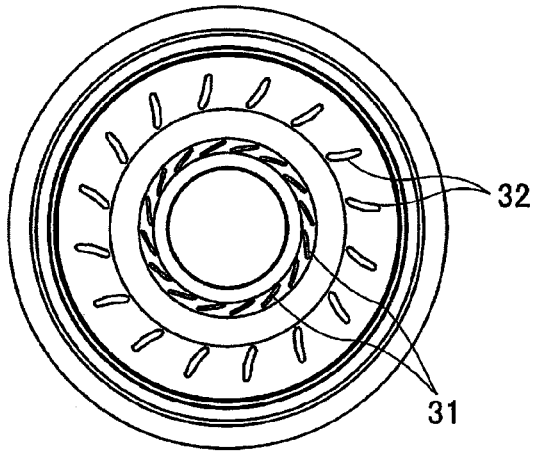
FIG. 5A is a plan view showing a side plate.
Figure 5B:
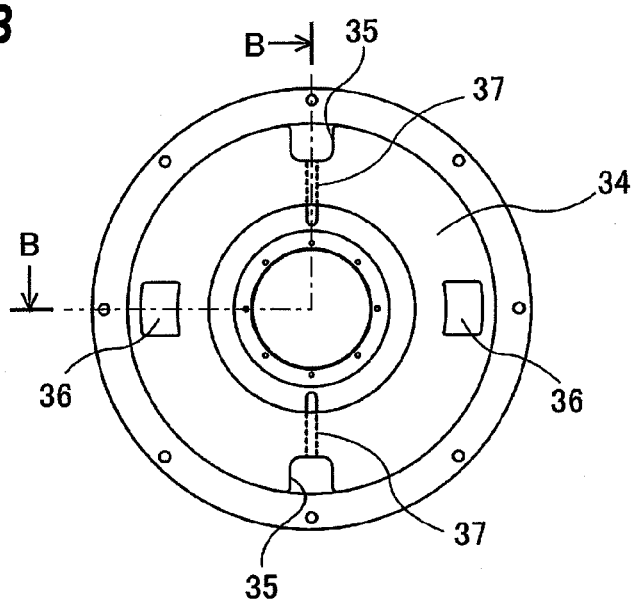
FIG. 5B is a bottom view showing the side plate.
Figure 5C:
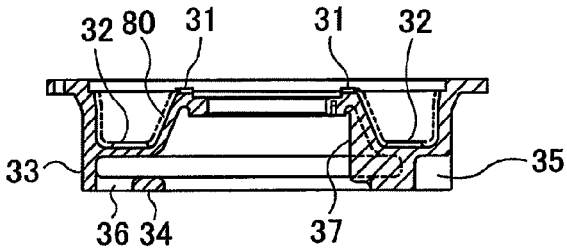
FIG. 5C is a cross-sectional view taken along line B-B in FIG. 5B.

FIG. 5A is a plan view showing the side plate (annular wall), FIG. 5B is a bottom view showing the side plate, and FIG. 5C is a cross-sectional view taken along line B-B in FIG. 5B. The side plate (an annular wall) 30 has a substantially annular shape. The heat-exchange passage 80 is formed on the upper surface of the side plate 30, and the handled liquid contacts a lower surface of the side plate 30. This side plate 30 serves as the heat-exchange member for performing the heat exchange between the coolant and the handled liquid. It is preferable that the side plate 30 be made of material having a high thermal conductivity, such as bronze or brass. The side plate 30 is secured to the intermediate casing 60 with the bolts 46. No components, other than a first stationary seal section of the tandem mechanical seal 90, are secured to the side plate 30. Therefore, material and shape that exhibit relatively low strength are permitted to be used for the side plate 30, because the side plate 30 is not required to support heavy components, such as the motor 3 or the volute casing 19.

Inner guide vanes 31 and outer guide vanes 32 are provided on the upper surface of the side plate 30. The inner guide vanes 31 are located in the inner horizontal passage 81, and the outer guide vanes 32 are located in the outer horizontal passage 83. The inner guide vanes 31 and the outer guide vanes 32 are provided for the purpose of conditioning the flow of the coolant. As shown in FIG. 5A, an angle of the inner guide vanes 31 with respect to a tangential direction of a virtual circle (not shown in the drawing) that is concentric with the rotational shaft 1 is smaller than an angle of the outer guide vanes 32 with respect to the above tangential direction, so that the inner guide vanes 31 do not disturb the swirling component of the coolant.

The upper surface (front surface) of the side plate (annular wall) 30 contacts the coolant, while the lower surface (rear surface) of the side plate 30 contacts the handled liquid. A vertical extension wall 33 having a cylindrical shape and extending toward the main impeller 12 is formed on the lower surface of the side plate 30. Further, a horizontal extension wall 34 extending radially inwardly from a lower end of the vertical extension wall 33 is provided. These extension walls 33 and 34 serve to increase a contact area between the handled liquid and the side plate 30, i.e., the heat transfer area. The horizontal extension wall 34 is arranged so as to face the rear vanes 14. The side plate (annular wall) 30 partitions a space above the main impeller 12 into an inner circumferential space 41 and an outer circumferential space 42, as shown in FIG. 1 and FIG. 3.

The vertical extension wall 33 has inwardly recessed portions, which form recesses 35. These recesses 35 provide upward channels that lead part of the liquid, delivered radially outwardly by the rear vanes 14, upwardly from the rear vanes 14. The recesses 35 face the rear vanes 14 and the outer circumferential space 42. Inner ends of the recesses 35 lie radially outwardly of inner ends of the rear vanes 14 facing the recesses 35. Therefore, the liquid, pressurized by the rear vanes 14, is supplied to the recesses 35. This pressurized liquid ascends from the rear vanes 14 through the recesses 35 to flow on the outer circumferential surface of the side plate 30. This flow of the liquid stirs and circulates the liquid in the outer circumferential space 42 located at the back side of the main impeller 12.

The horizontal extension wall 34 has through-holes 36 formed therein. These through-holes 36 provide return channels that lead part of the liquid, delivered radially outwardly by the rear vanes 14, back to the inner circumferential space 41. Inner ends of the through-holes 36 lie radially outwardly of the inner ends of the rear vanes 14 facing the through-holes 36. Therefore, the liquid, pressurized by the rear vanes 14, is supplied to the through-holes 36. This pressurized liquid flows in the axial direction of the rotational shaft 1 to stir and circulate the liquid in the inner circumferential space 41 located at the back side of the main impeller 12. This flow of the liquid has a swirling component. This swirling flow is disturbed by a plurality of baffles (ribs) 37 provided on the lower surface of the side plate 30, whereby agitation of the liquid is further promoted. These baffles 37 are configured as vertical walls projecting radially inwardly.

Such stirring action and circulating action of the handled liquid prevent stagnation of the handled liquid that is used for the heat exchange with the side plate 30, thus improving the heat exchange efficiency. Air pocket is likely to be created in top regions of the inner circumferential space 41 and the outer circumferential space 42, particularly at the time of starting the operation of the pump. The presence of the air in these spaces not only lowers the heat exchange efficiency, but also adversely affects lubrication of the mechanical seal. According to the embodiment as described above, the rear vanes 14, the through-holes 36, the recesses 35, and the baffles 37 can stir the liquid in the spaces 41 and 42, so that the flow of the liquid can expel the trapped air from these spaces. While the submersible motor pump is described in this embodiment, structures for effectively expelling the air staying in the space behind the main impeller 12 can be applied to other types of pumps.

Figure 6A:
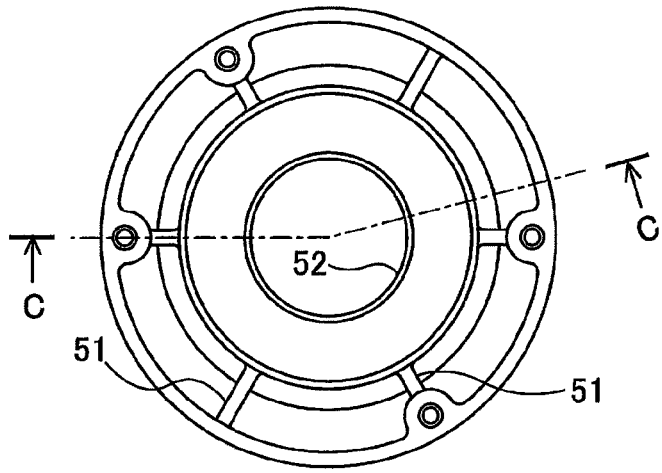
FIG. 6A is a plan view showing an inner casing.
Figure 6B:
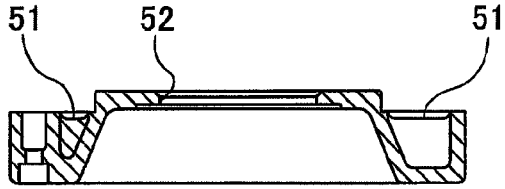
FIG. 6B is a cross-sectional view taken along line C-C in FIG. 6A.
Figure 6C:
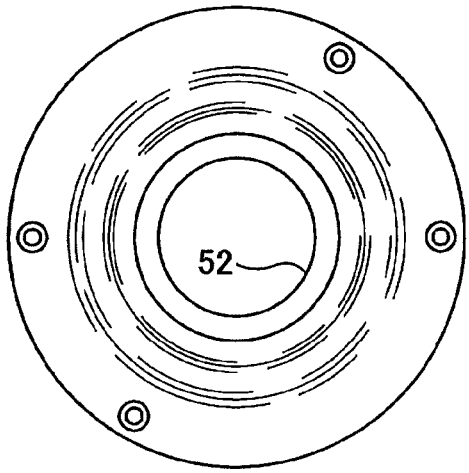
FIG. 6C is a bottom view showing the inner casing.

FIG. 6A is a plan view showing the inner casing, FIG. 6B is a cross-sectional view taken along line C-C in FIG. 6A, and FIG. 6C is a bottom view showing the inner casing. The inner casing 50 has an approximately annular shape. Radially extending ribs 51 are provided on an upper surface of the inner casing 50. The rear surface (i.e., the lower surface) of the inner casing 50 forms, together with the side plate 30, the heat-exchange passage 80. An inner circumferential edge 52 of the inner casing 50 serves as a liner ring (or casing ring) for the centrifugal impeller 20. That is, the upper opening of the inner casing 50 constitutes a suction opening of the circulation pump for the coolant.

Figure 7A:
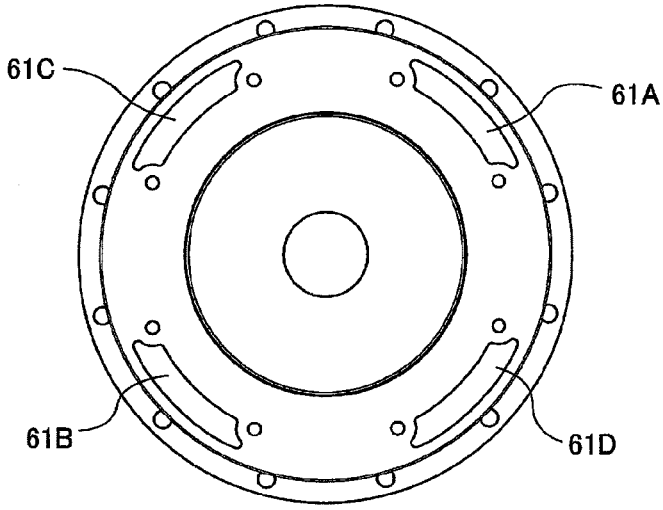
FIG. 7A is a plan view showing an intermediate casing.
Figure 7B:
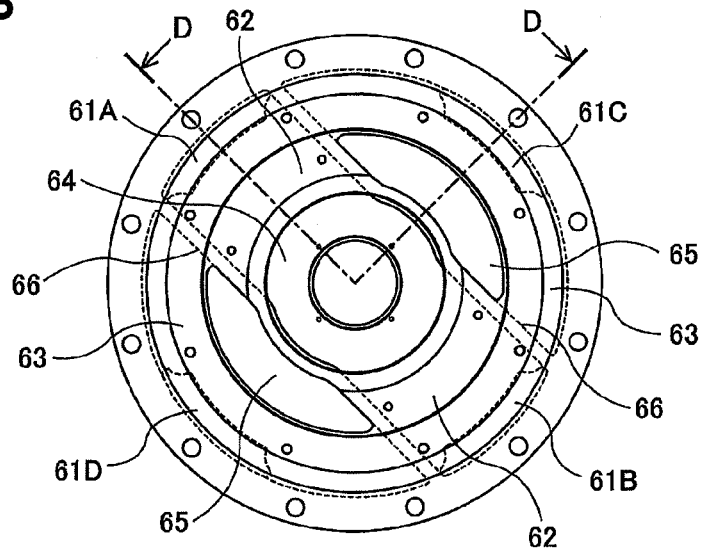
FIG. 7B is a bottom view showing the intermediate casing.
Figure 7C:
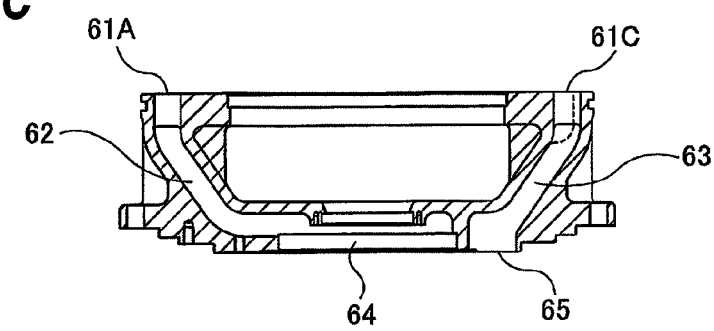
FIG. 7C is a cross-sectional view taken along line D-D in FIG. 7B.

FIG. 7A is a plan view showing the intermediate casing, FIG. 7B is a bottom view showing the intermediate casing, and FIG. 7C is a cross-sectional view taken along line D-D in FIG. 7B. An upper surface of the intermediate casing 60 has four openings (i.e., two entrances 61A and 61B, and two exits 61C and 61D). These openings 61A, 61B, 61C, and 61D are arranged at equal intervals along the circumferential direction. The entrances 61A and 61B are connected to the return passages 24C and 24D of the water jacket 11, respectively, and the exits 61C and 61D are connected to the outward passages 24A and 24B of the water jacket 11, respectively. The two entrances 61A and 61B are in fluid communication with a housing space 64, located in a center of a lower portion of the intermediate casing 60, through two inlet passages (suction passages) 62 penetrating vertically through the intermediate casing 60. In the housing space 64, the mechanical seal 90 and the centrifugal impeller 20 are disposed. The two exits 61C and 61D are in fluid communication with two coolant outlets 65, respectively, through two outlet passages 63 penetrating vertically through the intermediate casing 60. The coolant outlets 65 are formed in the lower surface of the intermediate casing 60.

As indicated by dotted lines in FIG. 7B, the inlet passages 62 and the outlet passages 63 of the intermediate casing 60 are separated by two partition walls 66, so that these passages 62 and 63 do not communicate with each other. The two inlet passages 62 are in fluid communication with each other through the housing space 64, while the two outlet passages 63 are not in fluid communication with each other and are provided as separate passages. The two coolant outlets 65 are connected to part of the end of the heat-exchange passage 80, so that the coolant that has been cooled by the handled liquid flows through the outlet passages 63 into the water jacket 11. Therefore, the heat-exchange passage 80 and the outlet passages 63 constitute a discharge passage that provides fluid communication between the centrifugal impeller 20 and the water jacket 11.

The end of the heat-exchange passage 80 is connected to the outlet passages 63 formed in the intermediate casing 60. The end of the heat-exchange passage 80 has an annular shape, while the outlet passages 63 are constituted by two of the four passages passing through the intermediate casing 60 in the axial direction, as described above. The outlet passages 63 are connected to the two axisymmetric outward passages 24A and 24B of the water jacket 11. The coolant flows through the outward passages 24A and 24B in the axial direction to cool the motor 3, impinges on the rubber sponge 21 to change its flow direction, and descends in the neighboring return passages 24C and 24D. The axisymmetric two return passages 24C and 24D are connected to the two inlet passages 62 (which are the other two of the four passages passing through the intermediate casing 60 in the axial direction), respectively, so that the coolant is led to the suction inlet of the centrifugal impeller 20. In this manner, the coolant circulates through the centrifugal impeller 20, the heat-exchange passage 80, the outlet passages 63, the water jacket 11 (the outward passages 24A and 24B and the return passages 24C and 24D), the inlet passages 62, and the centrifugal impeller 20.

Figure 8:
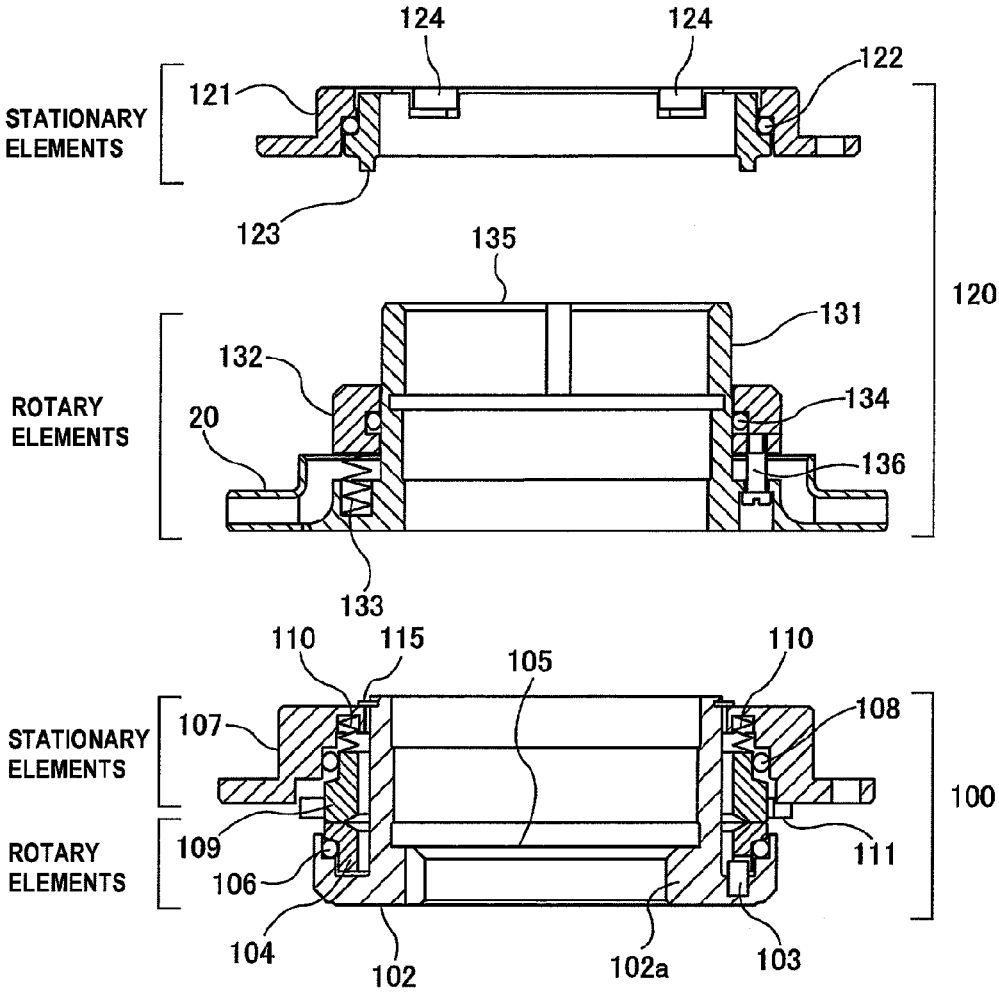
FIG. 8 is an exploded view showing the tandem mechanical seal.

FIG. 8 is an exploded view showing the tandem mechanical seal. The tandem mechanical seal 90 according to the present embodiment includes a first seal unit 100 having no centrifugal impeller and a second seal unit 120 having the centrifugal impeller 20. The first seal unit 100 and the second seal unit 120 are constructed as independent assemblies which can be separated from each other.

The first seal unit 100 includes, as rotary elements, a first sleeve 102 secured to the rotational shaft 1, and a first rotary seal ring 104 which is rotatable together with the first sleeve 102 through a pin 103. An O-ring 106 is disposed between the first sleeve 102 and the first rotary seal ring 104. The first seal unit 100 further includes, as stationary elements, a first static member 107 secured to the side plate 30 (which is a frame body of a rotary machine), a first stationary seal ring 109 supported by the first static member 107 through an O-ring 108, and springs 110 configured to press the first stationary seal ring 109 against the first rotary seal ring 104. The springs 110 are arranged between the first static member 107 and the first stationary seal ring 109. The first stationary seal ring 109 and the first static member 107 engage each other through engagement members 111, so that the first stationary seal ring 109 does not rotate. In this embodiment, the first stationary seal ring 109 and the first static member 107 constitute a first stationary seal section.

The first static member 107, the first rotary seal ring 104, and the first stationary seal ring 109 are arranged so as to surround the first sleeve 102. A snap ring 115 for restricting a displacement of the first static member 107 with respect to the first sleeve 102 caused by the springs 110 is provided on an outer circumferential surface of the first sleeve 102. The position of the snap ring 115 on the first sleeve 102 is such that the springs 110 do not stretch to their full length and the first stationary seal ring 109 and the first static member 107 do not disengage. This snap ring 115 can allow the first seal unit 100 to maintain its integrally assembled state even when the first seal unit 100 is not installed on the rotary machine. Therefore, the first seal unit 100 can be mounted on the pump simply by securing the first static member 107 to the frame body (i.e., the side plate 30). In particular, because positioning of the engagement members 111 and the pin 103 can be completed before the first seal unit 100 is mounted on the pump, the assembly of the pump can be facilitated.

The second seal unit 120 includes, as stationary elements, a second static member 121 secured to the intermediate casing 60 (i.e., a frame body of the rotary machine), and a second stationary seal ring 123 supported by the second static member 121 through an O-ring 122. The second stationary seal ring 123 engages the second static member 121 through engagement members 124 so as not to rotate. In this embodiment, the second stationary seal ring 123 and the second static member 121 constitute a second stationary seal section. The second seal unit 120 further includes, as rotary elements, a second sleeve 131 secured to the rotational shaft 1, a second rotary seal ring 132 which is rotatable together with the second sleeve 131, and springs 133 configured to press the second rotary seal ring 132 against the second stationary seal ring 123. An O-ring 134 is disposed between the second sleeve 131 and the second rotary seal ring 132.

The second rotary seal ring 132 is coupled to the second sleeve 131 with bolts 136. These bolts 136 are secured to the second rotary seal ring 132 and engage the second sleeve 131 loosely. The second rotary seal ring 132 and the bolts 136 are movable in the axial direction relative to the second sleeve 131. The bolts 136 serve as stopper for restricting a displacement of the second rotary seal ring 132 with respect to the second sleeve 131.

The centrifugal impeller 20 is formed integrally on an outer circumferential surface of the second sleeve 131. The centrifugal impeller 20 is arranged with its fluid inlet facing the second static member 121. The centrifugal impeller 20 is located between a sealing surface (i.e., contact surface between the first rotary seal ring 104 and the first stationary seal ring 109) of the first seal unit 100 and a sealing surface (i.e., contact surface between the second rotary seal ring 132 and the second stationary seal ring 123) of the second seal unit 120. The springs 133 are provided on a boss of the centrifugal impeller 20. The displacement of the second rotary seal ring 132 by the stretch of the springs 133 is limited by the bolts 136. Therefore, even when the rotary elements are not mounted on the rotary machine, the rotary elements can maintain an integrally assembled state. Further, because the first sleeve 102 and the second sleeve 131 are constructed as separate components, the first seal unit 100 and the second seal unit 120 can be separated as independent assemblies.

Procedures for installing the tandem mechanical seal 90 in the rotary machine are as follows:

1. The stationary elements of the second seal unit 120 are secured to the intermediate casing 60 with the bolts 55 (see FIG. 3).
2. The inner casing 50 is secured to the intermediate casing 60 with the bolts 45 (see FIG. 1).
3. A key 140 (see FIG. 3) is attached to the rotational shaft 1, and the rotary elements of the second seal unit 120 are mounted on the rotational shaft 1.
4. The side plate 30 is secured to the intermediate casing 60 with the bolts 46 (see FIG. 1).
5. A pin 141 (see FIG. 3) is attached to the rotational shaft 1, and the first seal unit 100 is secured to the side plate 30 with the bolts 56 (see FIG. 3).
6. The main impeller 12 is secured to the rotational shaft 1 with a bolt 47 (see FIG. 1).

When the main impeller 12 is mounted on the rotational shaft 1, the first seal unit 100 and the second seal unit 120 are biased upwardly in FIG. 3 to cause the springs 110 and 133 to contract. As shown in FIG. 8, a lower portion of the first sleeve 102 is a small-diameter portion 102*a*, whose upper end surface (a first positioning surface) 105 contacts a first step surface 1*a* of the rotational shaft 1, as shown in FIG. 3. An upper end of the first sleeve 102 contacts a lower end of the second sleeve 131. Further, an upper end surface (a second positioning surface) 135 of the second sleeve 131 contacts a second step surface 1*b* of the rotational shaft 1. In this manner, positioning of the first sleeve 102 and the second sleeve 131 is accomplished. Torque of the rotational shaft 1 is transmitted to the first sleeve 102 and the second sleeve 131 via the pin 141 and the key 140, which serve as torque transmission members, respectively.

The closed-type centrifugal impeller 20 requires installation of a liner ring. As can be seen from FIG. 3, since the fluid inlet of the centrifugal impeller 20 has a small diameter, the liner ring should be placed at a position between the second static member 121 and the centrifugal impeller 20. In the present embodiment, the second seal unit 120 is constructed by two independent assemblies, i.e., the stationary elements and the rotary elements, and these two assemblies are mounted on the rotary machine individually. Therefore, a small-diameter liner ring can be disposed between the stationary elements and the centrifugal impeller 20.

Further, because the first sleeve 102 and the second sleeve 131 are provided as separate components so that the first seal unit 100 and the second seal unit 120 can be separated, a frame body of the pump (e.g., the side plate 30 in this example) can be inserted even in a space sandwiched between the first static member 107 of the first seal unit 100 and the centrifugal impeller 20. With these configurations, an outside diameter of the mechanical seal can be made small. Furthermore, because the side plate 30, which is made of material having a high thermal conductivity, can be inserted into a space located inwardly of the fluid outlet of the centrifugal impeller 20, the heat exchange between the high-velocity coolant just discharged from the impeller 20 and the handled liquid can be performed securely through the side plate 30.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A submersible motor pump, comprising:

a water jacket having a circulation passage for a coolant;

a motor surrounded by said water jacket;

a rotational shaft rotated by said motor;

a main impeller secured to said rotational shaft;

a centrifugal impeller for circulating the coolant, said centrifugal impeller being rotatable together with said rotational shaft;

a suction passage configured to provide fluid communication between said circulation passage and a fluid inlet of said centrifugal impeller;

a discharge passage configured to provide fluid communication between a fluid outlet of said centrifugal impeller and said circulation passage; and an annular wall having a horizontal extension wall located above said main impeller;

wherein said discharge passage includes a heat-exchange passage formed by two wall surfaces facing each other, wherein one of said two wall surfaces is constituted by said annular wall configured to contact a liquid conveyed by said main impeller, wherein said heat-exchange passage has a circular shape extending radially outwardly from said fluid outlet of said centrifugal impeller, wherein said heat-exchange passage includes at least one axial passage section having a length component in an axial direction of said rotational shaft, wherein said main impeller has main blades for pressurizing the liquid and rear vanes facing said horizontal extension wall of said annular wall, wherein said annular wall is configured to separate a space above said main impeller into an inner circumferential space and an outer circumferential space, and wherein said horizontal extension wall has a through-hole configured to allow a portion of the liquid which is conveyed radially outwardly by said rear vanes of said main impeller to return to said inner circumferential space.

2. The submersible motor pump according to claim 1, wherein:

said axial passage section further has a length component in a radial direction of said centrifugal impeller; and the length component in the axial direction is longer than the length component in the radial direction.

3. The submersible motor pump according to claim 1, wherein said heat-exchange passage further includes at least one radial passage section having only a length component in a radial direction of said centrifugal impeller.

4. The submersible motor pump according to claim 3, further comprising guide vanes provided in said radial passage section.

5. The submersible motor pump according to claim 3, wherein:

said at least one axial passage section comprises a first axial passage section and a second axial passage section;

said at least one radial passage section comprises a first radial passage section and a second radial passage section; and said first radial passage section, said first axial passage section, said second radial passage section, and said second axial passage section are arranged in this order with respect to a circulation of the coolant to provide said heat-exchange passage.

6. The submersible motor pump according to claim 1, wherein said heat-exchange passage has a constant height over an entire length thereof.

7. The submersible motor pump according to claim 1, wherein:

said circulation passage comprises an outward passage and a return passage which are separated by partition plates;

said discharge passage is connected to an inlet of said outward passage;

an outlet of said outward passage is connected to an inlet of said return passage; and an outlet of said return passage is connected to said suction passage.

8. The submersible motor pump according to claim 1, wherein a flexible block is disposed in said water jacket, and a region of a gas contacting the coolant does not exist in said circulation passage.

9. The submersible motor pump according to claim 8, wherein said flexible block comprises a closed-cell foam rubber sponge.

10. The submersible motor pump according to claim 1, wherein a baffle for disturbing a swirling flow of the liquid is provided in said inner circumferential space.

11. The submersible motor pump according to claim 1, wherein said through-hole of said annular wall forms an upward channel through which part of the liquid conveyed radially outwardly by said rear vanes is directed upwardly from said rear vanes, and said upward channel is in fluid communication with said outer circumferential space.

12. A motor pump, comprising:

a motor;

a rotational shaft rotated by said motor;

an impeller secured to said rotational shaft; and an annular wall arranged above said impeller, wherein said impeller has main blades for pressurizing a liquid and rear vanes facing said annular wall, wherein said annular wall is shaped so as to separate a space above said impeller into an inner circumferential space and an outer circumferential space, and wherein said annular wall has an upward channel located above said rear vanes and arranged to face said rear vanes such that a part of the liquid conveyed radially outwardly by said rear vanes is directed upwardly from said rear vanes through said upward channel, and said upward channel is in fluid communication with said outer circumferential space.

13. The motor pump according to claim 12, wherein:

said annular wall forms a heat-exchange passage for performing heat exchange between the liquid and a coolant; and said motor pump further comprises a water jacket surrounding said motor, and a circulating mechanism for circulating the coolant between said water jacket and said heat-exchange passage.

* * * * *